United States Patent [19]

Oka et al.

[11] 4,113,519

[45] Sep. 12, 1978

[54] PHOSPHATING OF METALLIC SUBSTRATE WITH ELECTROLYTIC REDUCTION OF NITRATE IONS

[75] Inventors: Shoji Oka, Nara; Ryoichi Murakami, Kyoto; Akiko Sueyoshi, Osaka, all of Japan

[73] Assignee: Nippon Paint Co., Ltd., Osaka, Japan

[21] Appl. No.: 791,470

[22] Filed: Apr. 27, 1977

[30] Foreign Application Priority Data

Apr. 27, 1976 [JP] Japan ..... 51-49023

[51] Int. Cl.[2] ..... C23F 7/10

[52] U.S. Cl. ..... 148/6.15 R; 148/6.15 Z; 204/DIG. 13; 427/345

[58] Field of Search ..... 204/DIG. 13, 102, 103, 204/91; 148/6.15 R, 6.15 Z; 427/345; 118/620, 602, 603; 156/642

[56] References Cited

U.S. PATENT DOCUMENTS

| | | | |
|---|---|---|---|
| 3,510,412 | 5/1970 | Raviv et al. | 204/103 |
| 3,616,304 | 10/1971 | Bedi | 204/DIG. 13 |
| 3,640,805 | 2/1972 | Knight et al. | 204/DIG. 13 |
| 3,996,072 | 12/1976 | Oka et al. | 148/6.15 R |

FOREIGN PATENT DOCUMENTS

| | | | |
|---|---|---|---|
| 2,351,153 | 6/1974 | Fed. Rep. of Germany | 148/6.15 R |

*Primary Examiner*—Ralph S. Kendall

*Attorney, Agent, or Firm*—Wenderoth, Lind & Ponack

[57] ABSTRACT

In a method for phosphating the surface of a metallic substrate by treament with a phosphating solution comprising nitrite ions as the accelerator, an improvement wherein the supply of the nitrite ions to the phosphating solution is carried out by electrolytic reduction of nitrate ions present in the phosphating solution, whereby a desired concentration of nitrite ions in the phosphating solution is maintained without accumulation of alkali metal and/or ammonium ions unavailable for the phosphating and a uniform phosphate coating film having satisfactorily good coating properties is formed on said surface.

17 Claims, 4 Drawing Figures

PHOSPHATING OF METALLIC SUBSTRATE WITH ELECTROLYTIC REDUCTION OF NITRATE IONS

Figure 1:
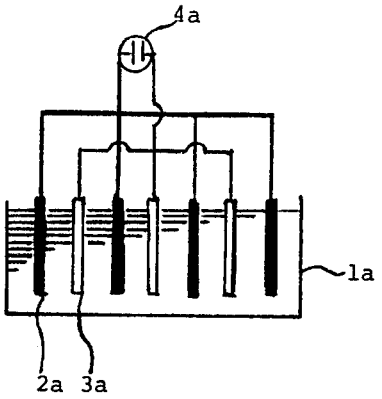
Figure 1:
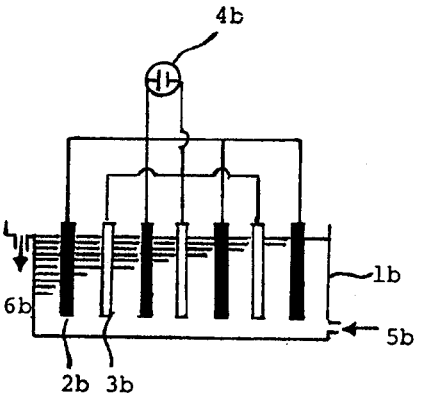

The present invention relates to an improvement in phosphating of a metallic substrate. More particularly, it relates to an improved method for formation of a phosphate coating film having good coating properties on the surface of a metallic substrate by treatment with a phosphating solution while maintaining appropriate concentrations of useful ions in the phosphating solution without accumulation of unfavorable ions.

In a phosphating process, metallic ions available for formation of a phosphate coating film and other ionic components in the phosphating solution are consumed with the progress of phosphating. Further, the loss of the ionic components in considerable amounts occurs since those are taken out as the "dragout" with the metallic substrate to be phosphated from the phosphating solution. Therefore, replenishment of the ionic components to the phosphating solution becomes necessary in the course in phosphating. Such replenishment is also needed for concurrently maintaining the acid ratio and total acidity of the phosphating solution and the concentrations of the ionic components at appropriate levels.

Among various ionic components, nitrite ions available as an accelerator are usually replenished by adding alkali metal and/or ammonium nitrites to the phosphating solution. Such replenishment, however, permits the accumulation of alkali metal and/or ammonium ions unavailable for formation of a phosphate coating film and concurrently raises a pH value of the phosphating solution, thereby causing the precipitation of zinc phosphate according to the following reaction formula:

$$3Zn(H_2PO_4)_2 \rightleftarrows 4H_3PO_4 + Zn_3(PO_4)_2 \downarrow$$

Thus, the precipitation of zinc phosphate gives rise to a decrease in the concentration of zinc ions in the phosphating solution. Further, the nitrite ions in the phosphating solution are partly converted into nitrate ions by oxidation, thereby resulting in a high concentration of nitrate ions, which imparts the phosphating. As a consequence, an insufficient phosphate coating film is formed on the surface of the metallic substrate, and poor coating or rusting results.

On the other hand, the phosphating solution which is carried away as the "dragout" by adhering to the metallic substrate is drained together with a large amount of water. This drain, however, is a cause of contamination or pollution if it is directly discharged without any waste disposal treatment to remove the heavy metal ions present therein. The said drain should accordingly be treated prior to discharge, and such a waste disposal treatment raises the cost of the phosphating. The use of a large amount of water may also present a problem from an environmental point of view. In order to obviate these disadvantages, the employment of an apparatus as described and claimed in U.S. Pat. No. 3,906,895, in which little or no phosphating solution is drained off from the phosphating system is particularly preferred. The problem here, however, is that, since the apparatus is of the type designed to drain off little or no phosphating solution out of the phosphating system, accumulation of the undesired ions may take place faster than when an apparatus of the conventional type, i.e. one designed to drain off a considerable amount of waste is employed. In addition, the more occasional renewal of the phosphating solution is required insofar as a conventional phosphating solution is employed.

Where a phosphating solution which contains a nitrite such as alkali metal nitrite or ammonium nitrite as the accelerator is used, the following two points should be mainly considered to solve the problems as described hereinabove and to provide a satisfactory phosphate coating film on a metallic substrate. First, the phosphating process should be carried out in which the accumulation of alkali metal and/or ammonium ions can be prevented or removal thereof made with ease. If the use of nitrous acid is possible, the problem with the accumulation of those unfavorable ions may be avoidable. However, nitrous acid cannot be used effectively under conventional conditions because of its instability in chemical properties and difficultly in handling. Secondly, the accumulation of nitrate ions in a phosphating solution to an undesirably high concentration should be prevented or the accumulated nitrate ions should be removed with ease.

In order to avoid the disadvantages involved in conventional phosphating processes, some attempts have been made; for example, U.S. Pat. No. 3,015,594 discloses the use of highly acidic cation-exchange resins substantially saturated and loaded with the coating metal ions. Since these cation-exchange resins possess a negatively charged matrix and exchangeable positive ions (cation) as is well known to the art, they cannot function as an exchange for anions. Thus, the sole employment of cation-exchange resins cannot decrease the nitrate ions accumulated in the phosphating solution to high concentrations. U.S. Pat. No. 3,996,972 proposes the use of anion-exchange resins for treatment of the phosphating solution for obviating the disadvantages present in the use of cation-exchange resins. While this method is quite successful, it still has drawbacks such as requiring treatment of anion-exchange resins for regeneration, which makes the operation complicated. Further, a troublesome problem of disposal of waste materials (e.g. sodium nitrate) arises from such regeneration treatment.

As the result of the extensive study, it has been found that the application of a direct current to electrodes available as the cathode and the anode and dipped in a phosphating solution comprising nitrate ions reduces electrolytically the nitrate ions to nitrite ions as shown in the following formula:

$$NO_3^- + 3\,H^+ + 2\,e \rightarrow HNO_2 + H_2O.$$

The appropriate control of the conditions in the electrolytic reduction makes it possible to maintain a constant concentration of nitrite ions in the phosphating solution. While various reports have heretofore been made on the electrolytic reduction of nitric acid, most of them pertain to the conversion of nitric acid into hydroxylamine or ammonia. Therefore, it is unexpected that the electrolytic reduction of nitric acid in the phosphating solution can stop at the stage of nitrous acid. The present invention is based on such a finding.

A main object of the present invention is to provide a method for controlling a phosphating solution, particularly the ionic concentrations in such solution. Another object of this invention is to provide a method for phosphating the surface of a metallic substrate with a phosphating solution, in which the nitrite ions are maintained at a desired level without accumulation of unfavorable ions. A further object of the invention is to provide a method for formation of a phosphate coating film having good coating properties on the surface of a metallic substrate continuously with a phosphating solution, in which the concentration of nitrite ions is appropriately controlled without accumulation of unfavorable ions. These and other objects of the invention will be apparent to those skilled in the art from the foregoing and subsequent descriptions.

According to the present invention, a phosphating solution comprising nitrate ions is subjected to electrolytic reduction for conversion of the nitrate ions into nitrite ions so as to attain a desired level of nitrite ions in the phosphating solution. Since nitrite ions can be produced from nitrite ions as the result of the electrolytic reduction, the initial composition of the phosphating solution is not necessarily required to include nitrite ions. Usually, however, the phosphating solution is favored to include nitrite ions from the beginning, because it takes a relatively long time to obtain the desired level of nitrite ions by the electrolytic reduction, particularly when the apparatus and conditions for electrolysis are suitable for compensation of the consumed and/or lost amount of nitrite ions in the phosphating process so as to maintain a constant level of nitrite ions. Such initial concentration of nitrite ions may be made by any conventional procedure, for instance, by adding alkali metal nitrite (e.g. sodium nitrite) or ammonium nitrite to the phosphating solution. The amount of the nitrite for making the initial concentration of nitrite ions is so small that any unfavorable influence is not materially caused by alkali metal or ammonium ions, which are necessarily incorporated into the phosphating solution through the said addition. A favorable initial concentration of nitrite ions is within a range of 0.002 to 0.1% by weight, and this level may be preferably maintained during the phosphating. The initial concentration of nitrate ions in the phosphating solution is usually 0.2% by weight or higher, and the concentration of nitrate ions during the phosphating is preferred to be kept within a range of 0.2 to 5% by weight. When the concentration of nitrate ions is less than 0.2% by weight, the production efficiency of the nitrite ions is considerably decreased, and a large scale apparatus for electrolysis becomes necessary. In addition, the maintenance of the nitrite ions at a favorable level will become difficult.

The electrolytic reduction may be carried out by passing a direct current between at least one electrode as the cathode and at least one electrode as the anode, which are dipped in the phosphating solution, whereby the conversion of nitrate ions into nitrite ions takes place at the cathode. The electric current density at the cathode is usually from 0.01 to 15 $A/dm^2$, preferably from 0.1 to 8 $A/dm^2$, particularly from 0.5 to 3 $A/dm^2$. When the electric current density is more than 15 $A/dm^2$, the efficiency in the conversion of nitrate ions into nitrite ions is lowered. When less than 0.01 $A/dm^2$, a larger area of electrode is required, and a device of a larger scale becomes necessary. The electric current density at the anode may vary within a wide range and is usually not more than 30 $A/dm^2$. When the electric current density is over 30 $A/dm^2$, the efficiency in the conversion of nitrate ions into nitrite ions becomes inferior. In case of the electric current density being too small, a great area of electrode becomes necessary, and therefore it may be usually not less than 0.01 $A/dm^2$.

As the cathode, there is advantageously employed an electrode having a relatively large hydrogen overvoltage, which generates in the electrolysis little or substantially no hydrogen gas. Examples of such electrodes are those made of mercury, zinc, copper, lead, tin, titanium, etc. Among them, the use of a zinc electrode is particularly preferred. As the anode, there may be used an electrode made of a material hardly soluble or insoluble in the phosphating solution. Examples of such electrode are those made of platinum, platinum-plated titanium, oxidized noble metal such as oxides of noble metals (e.g. Ru, Ir) coated on Ti or Ta, lead dioxide, stainless steel, triiron tetroxide (magnetite), carbon, etc. A zinc electrode, which can be dissolved in the phosphating solution on the electrolysis, may be also used as the anode. While the use of a hardly soluble or insoluble electrode as exemplified above requires the supplementation of zinc ions in an amount corresponding to the consumption, it may be advantageous in not requiring the frequent exchange of the electrode and the occasional control of the pH of the phosphating solution. The use of a zinc electrode is advantageous in attaining automatically the supplementation of zinc ions into the phosphating solution, the frequent exchange of the electrode and the occasional control of the pH will be necessary.

Phosphating solutions as conventionally used for a phosphating process may be employed for the present invention. Such solutions can generally contain a variety of ions such as chloride, fluoride, borohydrofluoride, silicohydrofluoride, titanium hydrofluoride, tartrate, citrate, lactate, glycerophosphate, acid pyrophosphate, acid orthophosphate and nitrite ions, and metal ions such as zinc, nickel, manganese, iron and calcium ions. Although these conventional solutions are applicable to the present invention, preferable phosphating solutions to be used possess a pH value of from about 1.0 to 4.0. The acidic phosphate coating solutions which are applicable to the process of the present invention may include an acidic zinc phosphate coating solution, acidic zinc calcium phosphate coating solution and acidic zinc manganese phosphate coating solution. The acidic zinc phosphate coating solution may contain, as the essential ionic components, zinc ions, phosphate ions, nitrate ions and nitrite ions, respectively, in concentrations of from about 0.03 to 1% by weight, from about 0.2 to 10% by weight, from about 0.2 to 5% by weight and from about 0.002 to 0.1% by weight. Practically, it has the following composition: zinc ions, from about 0.05 to 0.5% by weight; nickel ions, from 0 to about 0.2% by weight; sodium ions, from 0 to about 0.5% by weight; phosphate ions, from about 0.2 to 2.0% by weight; nitrate ions, from about 0.2 to 2.0% by weight; and nitrite ions, from about 0.005 to 0.5% by weight. The acidic zinc calcium phosphate coating solution may contain calcium ions in an amount of from about 0.01 to 2.0% by weight in addition to the said composition of the acidic zinc phosphate coating solution. The acidic zinc manganese phosphate coating solution may contain manganese ions in an amount of from about 0.01 to 0.5% by weight in addition to the said composition of acidic zinc phosphate coating solution.

The method of the present invention can control the phosphating solution by replenishing nitrite ions themselves without replenishing a nitrite as the accelerating material, thereby not allowing the alkali metal and/or ammonium ions to accumulate in the phosphating solution and concurrently decreasing the amounts of salts of phosphate and the ions unavailable for formation of a phosphate coating film. Furthermore, the present invention can avoid a decrease in zinc ions due to the accumulation of alkali metal and/or ammonium ions in the phosphating solution. The present invention can also decrease any excessive amounts of phosphate ions which are consumed for the neutralization of alkali metal and/or ammonium ions so that the phosphating also becomes feasible in the total acid pointage of the solution ranging from about 2.5 to 7 points (as determined by the number of millimeters of 0.1 N sodium hydroxide solution required to neutralize 10 milliliters of the coating solution to a phenolphthalein end point); the phosphating according to the present invention can be effected far below the range, e.g. from 8 to 50 points, in which conventional methods are possible. The method of the present invention can also be carried out in a lower temperature and/or for a shorter period of time than conventional methods can.

In practice, the method of the present invention may be introduced into a phosphating process which comprises a series of steps. Thus, a conventional process for phosphating usually comprises the steps of cleaning or degreasing, water-rinsing, phosphate coating, water-rinsing and drying. The film formation step is the application of a phosphating solution to the surface of a metallic substrate to be phosphated by an appropriate operation (e.g. dipping, spraying). When the application is carried out by dipping, the surface is dipped in a tank having the phosphating solution therein. When the application is effected by spraying, the phosphating solution is sprayed onto the surface and collected in a tank placed beneath the same. The electrolysis according to this invention may be applied directly to the phosphating solution in such tank. Alternatively, the phosphating solution in the said tank may be circulated through a separate tank wherein the electrolysis according to this invention is carried out. Further, the electrolysis of this invention may be effected intermittently or continuously. In general, the continuous electrolysis so as to maintain a constant concentration of nitrite ions in the phosphating solution is preferred from the industrial viewpoint. The constant concentration of nitrite ions can be readily maintained by sending a direct current of appropriate and constant electric current density to the phosphating solution. When a constant electric current density is given, the electric voltage undergoes no material change.

Explaining the application of the method of this invention to a multiple station system more in details, the preferable installation in such system may comprise six or seven stations. For example, a six-station installation is arranged in which the first station is a cleaning or degreasing station; the second is a first water-rinsing station; the third is a second water-rinsing station; the fourth station corresponds to phosphate coating; the fifth is a third water-rinsing station; and the sixth station corresponds to a fourth water-rinsing station; said phosphate coating station being provided with a device for electrolysis by which the phosphating solution is subjected to electrolysis so as to control the nitrite ion concentration at an appropriate level. In the seven-station installation, an acidulating station or another water-rinsing station may be disposed adjacent the last water-rinsing station which is provided for the six-station installation. The metallic substrate, as phosphated passing from the last water-rinsing station, may then be dried conventionally so as to remove the residual liquid from the coated metal surfaces for further processing such as painting. Variations in the number of stations employed for effecting the phosphating can be made, for example, by the omission of one of the rinse stations or the addition thereto of another rinse station.

An apparatus which is described in U.S. Pat. No. 3,906,895 may be applicable preferably to the method of the present invention. The apparatus described in this patent is a spray type apparatus having a spray chamber for treatment of the surface of a metallic substrate with a phosphating solution, followed by rinsing the surface with water, in which little or no phosphating solution is discharged out of the system. In the application of this apparatus to the method of the present invention, a device for electrolysis of the phosphating solution is connected to the phosphating station.

Practical and presently preferred embodiments of the invention will be hereinafter illustrated by way of Examples with reference to the accompanying drawings wherein FIG. 1 (A) shows a schematic view of a device for electrolysis to be used per se as a tank in the phosphate coating step of the phosphating process, FIG. 1 (B) shows a schematic view of a device for electrolysis to be used in connection with a tank in the phosphate coating step of the phosphating process, FIG. 2 (A) shows a flowsheet of an example (the device for electrolysis being per se used as the tank in the phosphate coating step of the phosphating process) of the invention and FIG. 2 (B) shows a flowsheet of another example (the device for electrolysis being used in connection with the tank in the phosphate coating step of the phosphating process) of the invention. In the Examples, % is by weight unless otherwise indicated.

EXAMPLE 1

A phosphating solution comprising the following ion components (pH, 3.0) is employed:

| Ion | Concentration (%) |
|---|---|
| $Zn^{2+}$ | 0.10 |
| $Na^{+}$ | 0.44 |
| $PO_4^{3-}$ | 1.20 |
| $NO_3^{-}$ | 0.60 |
| $NO_2^{-}$ | 0.0 |

The phosphating solution (300 liters) is charged in a device as shown in FIG. 1 (A) of the accompanying drawings. In the device 1*a*, four electrodes as the anode 2*a* and three electrodes as the cathode 3*a*, both being made of zinc, are alternately arranged in a row (no diaphragm being present between the electrodes), and these electrodes 2*a* and 3*a* are connected to an electric source of direct current 4*a*. The area of each of these electrodes 2*a* and 3*a* is 527 $cm^2$. The total effective area of anode is $3 \times 527$ $cm^2$, and that of cathode is also $3 \times 527$ $cm^2$. Then, electrolysis is effected by sending to the solution a direct electric current for 95 minutes under the following conditions: electric current density for anode and cathode, 2.5 $A/dm^2$; value of total electric current, 39.5 A; voltage, 4.0 V (the inner temperature of the device 1 being kept at 50° to 55° C.). As a result, nitrite ions are produced in the phosphating solution to make a concentration of 0.008%. It is thus confirmed that nitrate ions are reduced into nitrite ions with an electric current efficiency of 45%.

Figure 2:
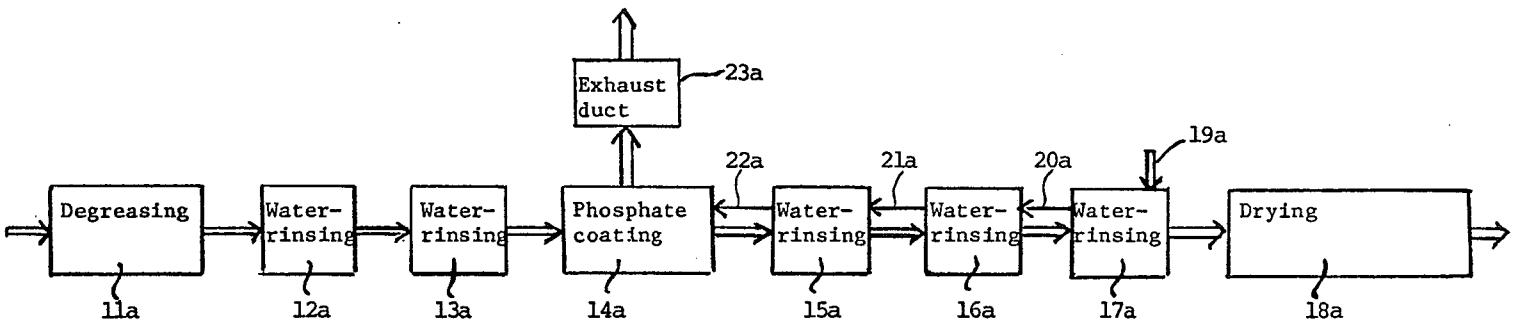
Figure 2:
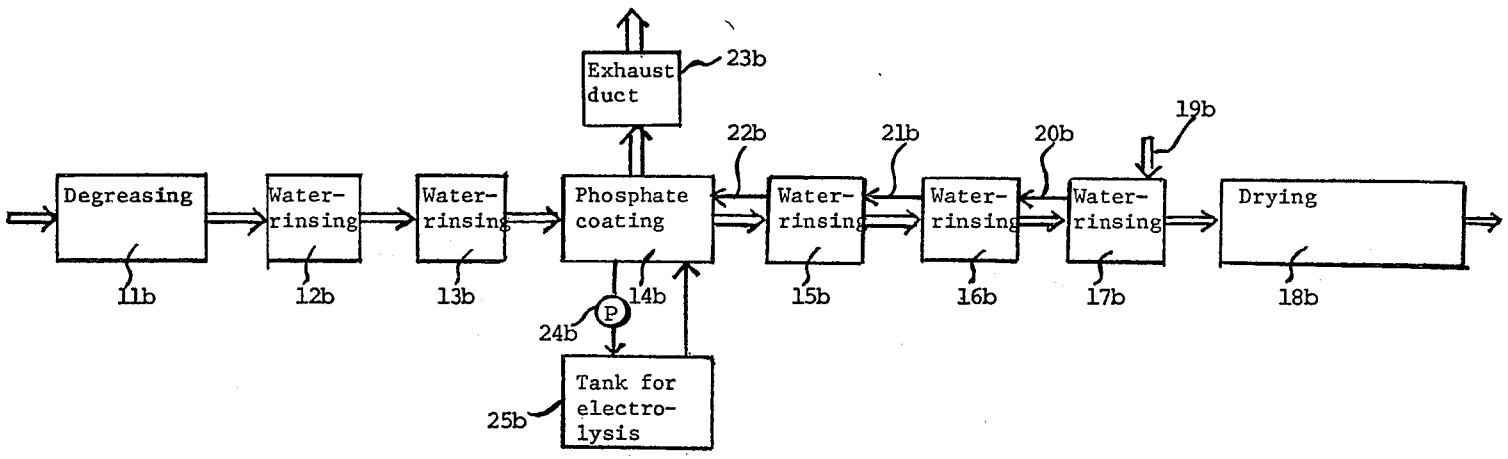

Using the nitrate and nitrite ion-containing phosphating solution thus obtained, phosphating of an iron plate is carried out in an installation (spray type) as shown in FIG. 2 (A) of the accompanying drawings, wherein the device for electrolysis as shown in FIG. 1 (A) is per se used as a tank in the phosphate coating step. The installation comprises the steps of degreasing 11*a*, water-rinsing 12*a* and 13*a*, phosphate coating 14*a*, water-rinsing 15*a*, 16*a* and 17*a* and drying 18*a*. The iron plate to be phosphated proceeds in the above order of the steps and is treated with the phosphating solution in the phosphate coating step 14*a* for 2 minutes. Fresh water 19*a* is supplied to the water-rinsing step 17*a*, the overflow 20*a* from this step is supplied to the water-rinsing step 16*a*, the overflow 21*a* from this step is supplied to the water-rinsing step 15*a*, and the overflow 22*a* from this step is supplied to the phosphate coating step 14*a*. By the exhaust duct 23*a*, evaporation of water in an amount corresponding to the overflow supplied to the phosphate coating step 14*a* is effected.

According to the above installation, the dragout from the phosphate coating step 14*a* can be recovered and returned to the tank in the phosphate coating step 14*a* without exhaustion of the ions in the phosphating solution to the outside of the system. Further, the amount of fresh water 19*a* to be used at the water-rinsing step 17*a* can be reduced.

The zinc phosphate film formed on the article by this Example is uniform and fine and has good properties.

EXAMPLE 2

A phosphating solution comprising the following ion components (pH, 3.0) is employed:

| Ion | Concentration (%) |
|---|---|
| $Zn^{2+}$ | 0.30 |
| $Ca^{2+}$ | 0.54 |
| $Na^{+}$ | 0.64 |
| $PO_4^{3-}$ | 0.60 |
| $PO_3^{-}$ | 3.60 |
| $NO_2^{-}$ | 0.0 |

The phosphating solution (300 liters) is subjected to electrolysis in the device for electrolysis 1*a* as shown in FIG. 1 (A) in the same manner as in Example 1 but changing the electric current sending time to 50 minutes and the inner temperature of the device 1*a* to 80° to 85° C., whereby nitrite ions are produced in the phosphating solution to make a concentration of 0.005%. It is thus confirmed that nitrate ions are reduced into nitrite ions with an electric current efficiency of 55%.

Using the nitrate and nitrite ion-containing phosphating solution thus obtained, phosphating of an iron plate is carried out as in Example 1 to form a uniform and fine calcium zinc phosphate film having excellent properties thereon.

EXAMPLE 3

A phosphating solution comprising the following ion component (pH, 3.0) is employed:

| Ion | Concentration (%) |
|---|---|
| $Zn^{2+}$ | 0.28 |
| $Mn^{2+}$ | 0.07 |
| $Na^{+}$ | 0.11 |
| $PO_4^{3-}$ | 1.05 |
| $NO_3^{-}$ | 0.30 |
| $NO_2^{-}$ | 0.0 |

The phosphating solution (300 liters) is subjected to electrolysis in the device for electrolysis 1*a* as shown in FIG. 1 (A) in the same manner as in Example 1 but changing the electric current sending time to 100 minutes, whereby nitrite ions are produced in the phosphating solution to make a concentration of 0.008%. It is thus confirmed that nitrate ions are reduced into nitrite ions with an electric current efficiency of 43%.

Using the nitrate and nitrite ion-containing phosphating solution thus obtained, phosphating of an iron plate is carried out as in Example 1 to form a uniform and fine manganese zinc phosphate film having excellent properties thereon.

EXAMPLE 4

Using a phosphating solution comprising the ion components as shown in Table 1 (pH, 3.0; degree of free acid, 1.0; total acidity, 15.0; acid ratio, 15), phosphating of an iron plate is carried out continuously in the installation as in Example 1 (treated area, 30 $m^2$/hr; temperature of phosphating solution, 50° to 55° C.). For supply of consumed nitrite ions (consumed amount per treated area of 30 $m^2$/hr, 0.33 mol/hr), addition of an aqueous solution of sodium nitrite (i.e. conventional method) or electrolysis (i.e. invention method) is effected. The ion composition of the phosphating solution after 100 and 300 hours from the beginning of the phosphating and the observation results of the phosphate coating film at these times are shown in Table 1.

In case of adopting the conventional method for supply of nitrite ions, a 20% aqueous solution of sodium nitrite is added to the phosphating solution depending on the consumption of nitrite ions to keep a nitrite ion concentration of 0.008%. In the invention method, on the other hand, nitrate ions are reduced into nitrite ions under the same electrolytic conditions as in Example 1 to keep a nitrite ion concentration of 0.008%. For consumed components other than nitrite ions, an aqueous solution mainly containing 2.4 mol/liter of zinc ions and 5.3 mol/liter of phosphate ions is employed in the conventional method, or an aqueous solution mainly containing 0.6 mol/liter of zinc ions, 5.3 mol/liter of phosphate ions and 0.76 mol/liter of nitrate ions is employed in the invention method. The speed of supply is 0.188 liter/hr in both cases.

Table 1

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 300 hrs |
| $Zn^{2+}$ | 0.10 | 0.056 | 0.023 | 0.09 | 0.10 |
| $Na^{+}$ | 0.44 | 0.59 | 0.85 | 0.45 | 0.44 |
| $PO_4^{3-}$ | 1.20 | 1.20 | 1.18 | 1.20 | 1.20 |
| $NO_3^{-}$ | 0.60 | 0.93 | 1.59 | 0.61 | 0.60 |
| $NO_2^{-}$ | 0.008 | 0.008 | 0.008 | 0.008 | 0.008 |
| Appearance of phosphate coating film | Uniform, fine, excellent | Coarse coating, not uniform, poor | Yellow rust, coarse coating, not uniform, poor | Uniform, fine, excellent | Uniform, fine excellent |

It is apparent from Table 1 that, by the control according to the conventional method, nitrate ions and sodium ions are accumulated in high concentrations in the phosphating solution, and the concentration of zinc ions is decreased to cause disadvantages in the phosphate coating. According to the invention method, neither the accumulation of nitrate ions and sodium ions nor the decrease of the zinc ion concentration is seen even after 300 hours, and the phosphate coating can be attained satisfactorily.

In case of introducing the invention method into the operation steps of a continuous phosphate coating treatment, a relatively long time (95 minutes in case of Example 1) is required for elevating the nitrite ion concentration to a desired level, unless nitrite ions are present in the phosphating solution at the beginning. Therefore, an appropriate amount of sodium nitrite may be practically added prior to the continuous phosphate coating treatment as seen in this Example. The presence of sodium ions caused thereby does not afford any significant unfavorable influence.

EXAMPLE 5

A phosphating solution comprising the following ion components (pH, 3.0) is employed:

| Ion | Concentration (%) |
|---|---|
| $Zn^{2+}$ | 0.10 |
| $Na^{+}$ | 0.44 |
| $PO_4^{3-}$ | 1.20 |
| $NO_3^{-}$ | 0.60 |
| $NO_2^{-}$ | 0.0 |

The same installation as used in Example 1 is employed, but the device for electrolysis is set up outside the phosphate coating tank. Thus, a device for electrolysis as shown in FIG. 1 (B) of the accompanying drawings is incorporated into the installation as shown in FIG. 2 (B) wherein the device for electrolysis is designated as 25b and set up separately from and in connection to a tank for phosphate coating designated as 14b. In FIG. 1 (B), the device 1b, the anode 2b, the cathode 3b and the electric source 4b correspond respectively to 1a, 2a, 3a and 4a in FIG. 1 (A), but the device 1b has an inlet 5b for the phosphating solution flowing from the tank for phosphate coating and an outlet 6b for the phosphating solution flowing to the tank for phosphate coating. In FIG. 2 (B), the steps of degreasing 11b, water-rinsing 12b and 13b, phosphate coating 14b, water-rinsing 15b, 16b and 17b and drying 18b as well as fresh water 19b, overflows 20b, 21b and 22b and an exhaust duct 23b correspond respectively to 11a, 12a, 13a, 14a, 15a, 16a, 17a and 18a as well as 19a, 20a, 21a, 22a and 23a in FIG. 2 (A), but the tank for the phosphate coating step 14b is connected with the device for electrolysis 25b, whereby the phosphating solution is circulated between them by the aid of a pump 24b. As the cathode, a zinc electrode is used, and as the anode, a stainless steel (NTK 430 (18-Cr stainless steel) electrode is employed. The total effective area of the anode is 0.16 $m^2$, and that of the cathode is also 0.16 $m^2$.

The phosphating solution (300 liters) is charged into the phosphate coating tank and made to circulate to the device for electrolysis by the aid of the pump. The inner temperature of the phosphate coating tank is kept to 50° to 55° C. Then, electrolysis is effected by sending a direct electric current for 95 minutes under the following conditions: electric current density, 2.5 $A/dm^2$; value of total electric current, 39.5 A; voltage between electrodes, 6 V. As the result, nitrite ions are produced in the phosphating solution to make a concentration of 0.008%. It is thus confirmed that nitrate ions are reduced into nitrite ions with an electric current efficiency of 45%.

Using the nitrate and nitrite ion-containing phosphating solution thus obtained, phosphating of an iron plate is carried out with a treating time of 2 minutes, whereby a uniform and fine zinc phosphate film having excellent properties is formed.

EXAMPLE 6

A phosphating solution comprising the following ion components (pH, 3.0) is employed:

| Ion | Concentration (%) |
|---|---|
| $Zn^{2+}$ | 0.30 |
| $Ca^{2+}$ | 0.54 |
| $Na^{+}$ | 0.64 |
| $PO_4^{3-}$ | 0.60 |
| $NO_3^{-}$ | 3.60 |
| $NO_2^{-}$ | 0.0 |

The installation used is the same as in Example 5, but a magnetite electrode is used as the anode. The conditions for electrolysis are the same as in Example 5 except that the voltage between electrodes is 7 V, the electric current-sending time is 50 minutes and the inner temperature of the phosphate coating tank is kept to 80 to 85° C. As the result of electrolysis of the phosphating solution (300 liters), nitrite ions are produced in the solution to make a concentration of 0.005%. It is thus confirmed that nitrate ions are reduced into nitrite ions with an electric current efficiency of 55%.

Using the nitrate and nitrite ion-containing phosphating solution thus obtained, phosphating of an iron plate is effected as in Example 5 to make a uniform and fine calcium zinc phosphate film having excellent properties.

EXAMPLE 7

A phosphating solution comprising the following ion components (pH, 3.0) is employed:

| Ion | Concentration (%) |
|---|---|
| $Zn^{2+}$ | 0.28 |
| $Mn^{2+}$ | 0.07 |
| $Na^{+}$ | 0.11 |
| $PO_4^{3-}$ | 1.05 |
| $NO_3^{-}$ | 0.30 |
| $NO_2^{-}$ | 0.0 |

The phosphating solution (300 liters) is subjected to electrolysis as in Example 5 but changing the electric current-sending time to 100 minutes, whereby nitrite ions are produced in the solution to make a concentration of 0.008%. It is thus confirmed that nitrate ions are reduced into nitrite ions with an electric current efficiency of 43%.

Using the nitrate and nitrite ion-containing phosphating solution thus obtained, phosphating of an iron plate is effected as in Example 5 to make a uniform and fine manganese zinc phosphate film having excellent properties.

EXAMPLE 8

Using a phosphating solution comprising the ion components as shown in Table 2 (pH, 3.0; degree of free acid, 1.0; total acidity, 15.0; acid ratio, 15), phosphating of an iron plate is carried out continuously in the installation as in Example 1 (treated area, 30 $m^2$/hr; temperature of phosphating solution, 50° to 55° C.). For supply of consumed nitrite ions (consumed amount per treated area of 30 $m^2$/hr, 0.33 mol/hr), addition of an aqueous solution of sodium nitrite (i.e. conventional method) or electrolysis (i.e. invention method) is effected. The ion composition of the phosphating solution after 100 and 300 hours from the beginning of the phosphating and the observation results of the phosphate coating film at these times are shown in Table 2.

In case of adopting the conventional method for supply of nitrite ions, a 20% aqueous solution of sodium nitrite is added to the phosphating solution depending on the consumption of nitrite ions to keep a nitrite ion concentration of 0.008%. In the invention method, on the other hand, nitrate ions are continuously reduced into nitrite ions under the same electrolytic condition as in Example 5 to keep a nitrite ion concentration of 0.008%. For supply of consumed components other than nitrite ions, an aqueous solution mainly containing 2.4 mol/liter of zinc ions and 5.3 mol/liter of phosphate ions is employed in the conventional method, or an aqueous solution mainly containing 2.4 mol/liter of zinc ions, 5.3 mol/liter of phosphate ions and 0.76 mol/liter of nitrate ions is employed in the invention method. The speed of supply is 0.188 liter/hr in both cases.

Table 2

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 300 hrs |
| $Zn^{2+}$ | 0.10 | 0.056 | 0.023 | 0.09 | 0.10 |
| $Na^{+}$ | 0.44 | 0.60 | 0.86 | 0.45 | 0.44 |
| $PO_4^{3-}$ | 1.20 | 1.20 | 1.18 | 1.20 | 1.20 |
| $NO_3^{-}$ | 0.60 | 0.93 | 1.59 | 0.61 | 0.60 |
| $NO_2^{-}$ | 0.008 | 0.008 | 0.008 | 0.008 | 0.008 |
| Appearance of phosphate coating film | Uniform, fine, excellent | Coarse coating, not uniform, poor | Yellow rust, coarse coating, not uniform, poor | Uniform, fine, excellent | Uniform, fine, excellent |

It is apparent from Table 2 that, by the control according to the conventional method, nitrate ions and sodium ions are accumulated in high concentrations in the phosphating solution, and the concentration of zinc ions is decreased to cause disadvantages in the phosphate coating. According to the invention method, neither the accumulation of nitrate ions and sodium ions nor the decrease of the zinc ion concentration is seen even after 300 hours and the phosphate coating can be attained satisfactorily.

In case of introducing the invention method into the operation steps of a continuous phosphate coating treatment, a relatively long time (95 minutes in case of Example 5) is required for elevating the nitrite ion concentration to a desired level, unless nitrite ions are present in the phosphating solution at the beginning. Therefore, an appropriate amount of sodium nitrite may be practically added prior to the continuous phosphate coating treatment as seen in this Example. The presence of sodium ions caused thereby does not afford any significant unfavorable influence.

EXAMPLE 9

A phosphating solution comprising the following ion components (pH, 3.0) is employed:

| Ion | Concentration (%) |
|---|---|
| $Zn^{2+}$ | 0.10 |
| $Na^{+}$ | 0.44 |
| $PO_4^{3-}$ | 1.20 |
| $NO_3^{-}$ | 0.60 |
| $NO_2^{-}$ | 0.0 |

The installation used is the same as in Example 5, but a zinc electrode is used as the cathode and a platinum-plated titanium electrode is employed as the anode. The total effective area of the cathode is 0.16 $m^2$, and that of the anode is 0.04 $m^2$. The phosphating solution (300 liters) is charged into the phosphate coating tank and made to circulate to the tank for electrolysis by the aid of a pump. The inner temperature of the phosphate coating tank is kept to 50° to 55° C. Then, electrolysis is effected by sending a direct electric current for 95 minutes under the following conditions: electric current density at cathode, 2.5 $A/dm^2$; electric current density at anode, 10 $A/dm^2$; value of total electric current, 39.5 A; voltage between electrodes, 10 V. As the result, nitrite ions are produced in the phosphating solution to make a concentration of 0.008%. It is thus confirmed that nitrate ions are reduced into nitrite ions with an electric current efficiency of 45%.

Using the nitrate and nitrite ion-containing phosphating solution thus obtained, phosphating of an iron plate is carried out with a treating time of 2 minutes to make a uniform and fine zinc phosphate film having excellent properties.

EXAMPLE 10

A phosphating solution comprising the following ion components (pH, 3.0) is employed:

| Ion | Concentration (%) |
|---|---|
| $Zn^{2+}$ | 0.30 |
| $Ca^{2+}$ | 0.54 |
| $Na^{+}$ | 0.64 |
| $PO_4^{3-}$ | 0.60 |
| $NO_3^{-}$ | 3.60 |
| $NO_2^{-}$ | 0.0 |

The installation used is the same as in Example 5, but an electrode of an oxidized noble metal (i.e. oxide of Ru coated on Ti) is used as the anode. The conditions for electrolysis are the same as in Example 9 except that the electric current-sending time is 50 minutes and the inner temperature of the phosphate coating tank is 80 to 85° C. As the result of electrolysis of the phosphating solution (300 liters), nitrite ions are produced in the solution to make a concentration of 0.005%. It is thus confirmed that nitrate ions are reduced into nitrite ions with an electric current efficiency of 55%.

Using the nitrate and nitrite ion-containing phosphating solution thus obtained, phosphating of an iron plate is effected as in Example 9 to make a uniform and fine calcium zinc phosphate film having excellent properties.

EXAMPLE 11

A phosphating solution comprising the following ion components (pH, 3.0) is employed:

| Ion | Concentration (%) |
|---|---|
| $Zn^{2+}$ | 0.28 |
| $Mn^{2+}$ | 0.07 |
| $Na^{+}$ | 0.11 |
| $PO_4^{3-}$ | 1.05 |
| $NO_3^{-}$ | 0.30 |

-continued

| Ion | Concentration (%) |
|---|---|
| $NO_2^-$ | 0.0 |

The phosphating solution (300 liters) is subjected to electrolysis as in Example 9 but changing the electric current-sending time to 100 minutes, whereby nitrite ions are produced in the solution to make a concentration of 0.008%. It is thus confirmed that nitrate ions are reduced into nitrite ions with an electric current efficiency of 43%.

Using the nitrate and nitrite ion-containing phosphating solution thus obtained, phosphating of an iron plate is effected as in Example 9 to make a uniform and fine manganese zinc phosphate film having excellent properties.

EXAMPLE 12

Using a phosphating solution comprising the ion components as shown in Table 3 (pH, 3.0; degree of free aci, 1.0; total acidity, 15.0; acid ratio, 15), phosphating of an iron plate is carried out continuously in the installation as in Example 1 (treated area, 30 $m^2$/hr, temperature of phosphating solution, 50° to 55° C.). For supply of consumed nitrite ions (consumed amount per treated area of 30 $m^2$/hr, 0.33 mol/hr), addition of an aqueous solution of sodium nitrite (i.e. conventional method) or electrolysis (i.e. invention method) is effected. The ion composition of the phosphating solution after 100 and 300 hours from the beginning of the phosphating and the observation results of the phosphate coating film at these times are shown in Table 3.

In case of adopting the conventional method for supply of nitrite ions, a 20% aqueous solution of sodium nitrite is added to the phosphating solution depending on the consumption of nitrite ions to keep a nitrite ion concentration of 0.008%. In the invention method, on the other hand, nitrate ions are reduced continuously into nitrite ions under the same electrolytic conditions as in Example 9 to keep a nitrite ion concentration of 0.008%. For supply of consumed components other than nitrite ions, an aqueous solution mainly containing 2.4 mol/liter of zinc ions and 5.3 mol/liter of phosphate ions is employed in the conventional method, or an aqueous solution mainly containing 2.4 mol/liter of zinc ions, 5.3 mol/liter of phosphate ions and 0.76 mol/liter of nitrate ions is employed in the invention method. The speed of supply is 0.188 liter/hr in both case.

Table 3

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 300 hrs |
| $Zn^{2+}$ | 0.10 | 0.056 | 0.023 | 0.09 | 0.10 |
| $Na^+$ | 0.44 | 0.60 | 0.86 | 0.45 | 0.44 |
| $PO_4^{3-}$ | 1.20 | 1.20 | 1.18 | 1.20 | 1.20 |
| $NO_3^-$ | 0.60 | 0.93 | 1.59 | 0.61 | 0.60 |
| $NO_2^-$ | 0.008 | 0.008 | 0.008 | 0.008 | 0.008 |
| Appearance of phosphate coating film | Uniform, fine, excellent | Coarse coating, not uniform, poor | Yellow rust, coarse coating, not uniform, poor | Uniform, fine, excellent | Uniform, fine, excellent |

It is apparent from Table 3 that, by the control according to the conventional method, nitrate ions and sodium ions are accumulated in high concentrations in the phosphating solution, and the concentration of zinc ions is decreased to cause disadvantages in the phosphate coating. According to the invention method, neither the accumulation of nitrate ions and sodium ions nor the decrease of the zinc ion concentration is seen even after 300 hours, and the phosphate coating can be attained satisfactorily.

In case of introducing the invention method into the operation steps of a continuous phosphate coating treatment, a relatively long time (95 minutes in case of Example 9) is required for elevating the nitrite ion concentration to a desired level, unless nitrite ions are present in the phosphating solution at the beginning. Therefore, an appropriate amount of sodium nitrite may be practically added prior to the continuous phosphate coating treatment as seen in this Example. The presence of sodium ions caused thereby does not afford any significant unfavorable influence.

EXAMPLE 13

The same installation as in Example 5 is used but a zinc electrode and a stainless steel electrode (NTK 430, 18-Cr stainless steel) are employed respectively as the cathode and the anode. The total area of the electrode is 0.16 $m^2$ for both of the cathode and the anode.

The initial composition of the phosphating solution is as follows: zinc ions, 0.15%; phosphate ions, 0.3%; nitrate ions, 0.3%; citrate ions 0.015%; nitrite ions, 0.01%; sodium ions, 0.082% (total acidity, 5.6; acid ratio, 14; pH, 3.0). The temperature of the phosphating solution is kept to 50° to 55° C. during phosphating. The phosphating solution is sprayed on the surface of an iron plate for 2 minutes. The amount of consumed nitrite ions per treated area of 30 $m^2$/hr is 0.33 mol/hr.

For supply of consumed nitrite ions, addition of an aqueous solution of sodium nitrite (i.e. conventional method) or electrolysis (i.e. invention method) is effected. Thus, according to the conventional method, a 20% aqueous solution of sodium nitrite is supplied depending on the consumption of nitrite ions so as to keep their concentration in the phosphating solution to 0.01%. According to the invention method an electric current of 41 A is sent continuously to the tank for electrolysis to reduce continuously a part of the nitrate ions in the phosphating solution into nitrite ions so as to keep their concentration to 0.01%. In this case, the electric current density is 2.6 A/$dm^2$, the electric voltage between the electrodes is 6 V and the electric current efficiency of nitrite ion-production is 43%.

For supply of the phosphating solution, an aqueous solution mainly containing 116 g/liter of zinc ions, 348 g/liter of phosphate ions, 50 g/liter of nitrate ions and 20 g/liter of citrate ions is added to maintain a constant total acidity.

The treated area is 30 $m^2$/hr in both the conventional method and the invention method. After 100 and 300 hours from the beginning of the phosphating, the ion concentrations of the phosphating solution are determined and the appearance of the phosphate coating film is observed. The results are shown in Table 4.

Table 4

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 100 hrs |
| $Zn^{2+}$ | 0.15 | 0.10 | 0.04 | 0.14 | 0.15 |
| $Na^+$ | 0.082 | 0.22 | 0.48 | 0.082 | 0.08 |
| $PO_4^{3-}$ | 0.30 | 0.30 | 0.29 | 0.30 | 0.30 |
| $NO_3^-$ | 0.30 | 0.58 | 1.17 | 0.28 | 0.29 |

Table 4-continued

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 100 hrs |
| $NO_2^-$ | 0.01 | 0.01 | 0.01 | 0.01 | 0.01 |
| Citrate ions | 0.015 | 0.015 | 0.014 | 0.015 | 0.014 |
| Appearance of phosphate coating film | Uniform, fine, excellent | Coarse coating, not uniform, poor | Yellow rust, coarse coating, not uniform, poor | Uniform, fine, excellent | Uniform, fine, excellent |

It is apparent from Table 4 that, according to the conventional method, nitrate ions and sodium ions are accumulated in high concentrations in the phosphating solution and the concentration of zinc ions is decreased so that the phosphate coating is accompanied with disadvantages such as yellow rust and coarse coating. According to the invention method, the concentrations of nitrate ions and sodium ions are scarcely changed even after 300 hours without accumulation of sodium ions and decrease of the concentration of zinc ions, which results in formation of a uniform, fine and excellent zinc phosphate film.

For overcoming the disadvantages such as yellow rust and coarse coating as seen after 300 hours in the conventional method, it is necessitated to elevate the total acidity to 12 to 15.

EXAMPLE 14

Using a phosphating solution comprising the ion components as shown in Table 5 (pH, 3.2; degree of free acid, 0.65; total acidity, 13; acid ratio, 20), phosphating of an iron plate is effected continuously under control of the phosphating solution according to the conventional method or the invention method. The temperature of the phosphating solution is kept at 35 to 40° C. The supply of nitrite ions and the phosphating solution is carried out as in Example 13. After 100 and 300 hours from the beginning of the phosphating, the ion concentrations of the phosphating solution are determined and the appearance of the phosphate coating film is observed. The results are shown in Table 5.

Table 5

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 100 hrs |
| $Zn^{2+}$ | 0.37 | 0.28 | 0.15 | 0.37 | 0.38 |
| $Na^+$ | 0.09 | 0.23 | 0.50 | 0.09 | 0.089 |
| $PO_4^{3-}$ | 0.68 | 0.67 | 0.67 | 0.68 | 0.67 |
| $NO_3^-$ | 0.5 | 0.71 | 1.19 | 0.5 | 0.52 |
| $NO_2^-$ | 0.01 | 0.01 | 0.01 | 0.01 | 0.01 |
| Appearance of phosphate coating film | Uniform, fine, excellent | Coarse coating, not uniform, poor | Yellow rust, coarse coating, not uniform, poor | Uniform, fine, excellent | Uniform, fine, excellent |

It is apparent from Table 5 that, according to the conventional method, accumulation of sodium ions and nitrate ions and decrease of zinc ions progress with lapse of time to cause disadvantages in the phosphate coating such as yellow rust and coarse coating. According to the invention method, such problem does not arise, and the phosphate coating can be continued at a low temperature under a normal state.

For overcoming the disadvantages in the film formation such as yellow rust and coarse coating seen after 300 hours in the conventional method, it is necessitated to elevate the treating temperature to 55 to 60° C.

EXAMPLE 15

Using a phosphating solution comprising the same ion components as in Example 14 except that the inner temperature of the phosphate coating tank is 50° to 55° C, phosphating of an iron plate is effected continuously under control of the phosphating solution according to the conventional method or the invention method. The spraying time is 30 seconds. The supply of nitrite ions and the phosphating solution is carried out as in Example 13. After 100 and 300 hours from the beginning of the phosphating, the ion concentrations of the phosphating solution are determined, and the appearance of the phosphate coating film is observed. The results are shown in Table 6.

Table 6

| | Ion concentration of phosphating solution (%) | | | | |
|---|---|---|---|---|---|
| | Initial | Conventional method | | Invention method | |
| | concentration | After 100 hrs | After 300 hrs | After 100 hrs | After 100 hrs |
| $Zn^{2+}$ | 0.37 | 0.25 | 0.112 | 0.38 | 0.38 |
| $Na^+$ | 0.09 | 0.25 | 0.57 | 0.089 | 0.09 |
| $PO_4^{3-}$ | 0.68 | 0.67 | 0.68 | 0.67 | 0.68 |
| $NO_3^-$ | 0.5 | 0.76 | 1.30 | 0.52 | 0.52 |
| $NO_2^-$ | 0.01 | 0.01 | 0.01 | 0.01 | 0.01 |
| Appearance of phosphate coating film | Uniform, fine, excellent | Coarse coating, not uniform, poor | Yellow rust, coarse coating, not uniform, poor | Uniform, fine, excellent | Uniform, fine, excellent |

It is shown in Table 6 that, at the initial stage of the phosphating, a uniform and fine film is prepared with a spraying time of 30 seconds. In continuation of the phosphating under the control according to the conventional method, however, the accumulation of sodium ions and nitrate ions and the decrease of zinc ions progress to cause disadvantages in the phosphate coating such as yellow rust and coarse coating. According to the invention method, a normal film can be prepared continuously.

For overcoming the disadvantages in the phosphate coating such as yellow rust and coarse coating as seen after 300 hours in the conventional method, it is necessitated to prolong the treating time to 1 minute and 30 seconds.

What is claimed is:

1. In a method for phosphating the surface of a metallic substrate by treatment with a phosphating solution comprising nitrite ions and nitrate ions in an aqueous acidic medium, the improvement wherein the supply of the nitrite ions to the phosphating solution is carried out by electrolytic reduction of the nitrate ions therein by passing a direct current between an electrode as the cathode and an electrode as the anode dipped in the phosphating solution.

2. The improvement according to claim 1, wherein the electrode as the cathode is made of mercury, zinc, copper, lead, tin or titanium.

3. The improvement according to claim 1, wherein the electrode as the anode is made of zinc, platinum, platinum-plated titanium, oxidized nobel metal, lead dioxide, stainless steel, triiron tetroxide or carbon.

4. The improvement according to claim 1, wherein the direct current at the cathode has an electric current density of 0.01 to 15 A/dm$^2$.

5. A method for formation of a phosphate coating film on the surface of a metallic substrate which comprises treating said surface with a phosphating solution comprising zinc ions, phosphate ions, nitrate ions and nitrite ions in an aqueous medium, all or at least a part of the nitrite ions being produced by electrolytic reduction of the nitrate ions in the phosphating solution so that the nitrite ion concentration in solution is replenished in amounts sufficient to produce a satisfactory phosphate coating film; said electrolytic reduction being carried out by passing a direct current between an electrode as the cathode and an electrode as the anode dipped in the phosphating solution.

6. The method according to claim 5, wherein the phosphating solution comprises zinc ions, phosphate ions, nitrate ions and nitrite ions in concentrations of 0.03 to 1% by weight, 0.2 to 10% by weight, 0.2 to 5% by weight and 0.002 to 0.1 % by weight, respectively.

7. The method according to claim 6, wherein the phosphating solution has a pH of 1 to 4.

8. The method according to claim 5, wherein the phosphating solution comprises further calcium ions.

9. The method according to claim 5, wherein the phosphating solution comprises further manganese ions.

10. The method according to claim 5, wherein the electrode as the cathode is made of mercury, zinc, copper, lead, tin or titanium.

11. The method according to claim 5, wherein the electrode as the anode is made of zinc, platinum, platinum-plated titanium, oxidized noble metal, lead dioxide, stainless steel, triiron tetroxide or carbon.

12. The method according to claim 5, wherein the electrode as the cathode is made of zinc and the electrode as the anode is made of stainless steel.

13. The method according to claim 5, wherein the direct current has an electric current density of 0.01 to 15 A/dm$^2$ at the cathode.

14. The method according to claim 5, wherein the treatment is effected by dipping the surface in the phosphating solution.

15. The method according to claim 5, wherein the treatment is effected by spraying the phosphating solution onto the surface.

16. The method according to claim 5, wherein the surface is degreased and rinsed with water before the treatment.

17. The method according to claim 5, wherein the surface is rinsed with water after the treatment.

* * * * *